US010019885B2

(12) United States Patent
Miyake et al.

(10) Patent No.: US 10,019,885 B2
(45) Date of Patent: Jul. 10, 2018

(54) WARNING NOTIFICATION DEVICE, ELECTRONIC WATCH, WARNING METHOD AND RECORDING MEDIUM

(71) Applicant: CASIO COMPUTER CO., LTD., Shibuya-ku, Tokyo (JP)

(72) Inventors: Takeshi Miyake, Mizuho-machi (JP); Tatsuyoshi Omura, Kodaira (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/391,780

(22) Filed: Dec. 27, 2016

(65) Prior Publication Data

US 2017/0249825 A1 Aug. 31, 2017

(30) Foreign Application Priority Data

Feb. 26, 2016 (JP) ..... 2016-035232

(51) Int. Cl.

| | |
|---|---|
| ***G08B 21/00*** | (2006.01) |
| ***G08B 21/08*** | (2006.01) |
| ***G08B 7/06*** | (2006.01) |
| ***G08B 29/18*** | (2006.01) |
| ***B63C 11/02*** | (2006.01) |

(52) U.S. Cl.

CPC ..... *G08B 21/088* (2013.01); *B63C 11/02* (2013.01); *G08B 7/06* (2013.01); *G08B 29/185* (2013.01)

(58) Field of Classification Search

CPC ..... G08B 21/088; G08B 29/185; G08B 7/06

USPC ..... 340/614, 573.1, 529, 540, 407.1, 984, 340/603, 626, 604, 870.1; 702/138, 139, 702/166

See application file for complete search history.

(56) References Cited

U.S. PATENT DOCUMENTS 5,852,630 A * 12/1998 Langberg ..... H04L 27/2647 375/219
6,060,994 A * 5/2000 Chen ..... G08B 25/08 340/3.9
2005/0007260 A1* 1/2005 Winter ..... G01F 15/063 340/870.01
2007/0162254 A1* 7/2007 Hirose ..... B63C 11/02 702/166

FOREIGN PATENT DOCUMENTS

JP 11023747 A 1/1999

* cited by examiner

*Primary Examiner* — Dhaval Patel
(74) *Attorney, Agent, or Firm* — Holtz, Holtz & Volek PC

(57) ABSTRACT

A warning notification device includes a sensor, a notification unit, and a processor. The processor is configured to calculate a water depth from an output of the sensor every predetermined time and to calculate a surfacing amount from a change in the calculated water depth every predetermined time. When a long-term surfacing speed condition, which is to be determined on the basis of the surfacing amounts of a first number, is satisfied or when a short-term surfacing speed condition, which is to be determined on the basis of the recent surfacing amounts of a second number smaller than the first number, is satisfied, the processor enables the notification unit to issue a warning of a surfacing operation.

20 Claims, 7 Drawing Sheets

FIG. 3

| WARNING DETERMINING METHODS | | WARNING DETERMINING CONDITIONS |
|---|---|---|
| A | MOVING AVERAGE SURFACING SPEED DETERMINATION | WHEN AVERAGE SURFACING AMOUNT OF 18 POINTS IS PREDETERMINED THRESHOLD OR GREATER, SURFACING SPEED WARNING IS ISSUED |
| B | RECENT MINIMUM SURFACING SPEED DETERMINATION | WHEN SURFACING SPEED IS PREDETERMINED THRESHOLD OR GREATER FOR 5 CONSECUTIVE POINTS, SURFACING SPEED WARNING IS ISSUED |

WARNING NOTIFICATION DEVICE, ELECTRONIC WATCH, WARNING METHOD AND RECORDING MEDIUM

CROSS-REFERENCE TO RELATED APPLICATION

This application is based upon and claims the benefit of priority from the prior Japanese Patent Application No. 2016-035232 filed on Feb. 26, 2016, and the entire contents of which are incorporated herein by reference.

BACKGROUND

1. Technical Field

The disclosure relates to a warning notification device, an electronic watch, a warning method and a recording medium configured to issue a warning of a surfacing speed during a diving.

2. Description of Related Art

In recent years, a wristwatch capable of being used underwater has been spread for marine sports such as scuba diving and a diving operation for performing an operation undersea or underwater. As the waterproof wristwatch for sports, a wristwatch having a pressure sensor embedded therein and configured to measure a water depth from a detected water pressure has been known.

In the meantime, during the diving, an inert gas such as nitrogen in the respiratory gas is dissolved in the body by a high pressure due to a water pressure. For this reason, it is necessary to take a sufficient rest time so that the inert gas accumulated in the body is completely discharged after the surfacing.

Also, since the excessive surfacing speed is a greatest factor causing the dysbarism, it is necessary to take measures so that the surfacing speed does not exceed a predetermined surfacing speed.

In an information processing device for a diver disclosed in Patent Document 1, which is configured to be useable with being attached to an arm, a water depth is detected by an embedded pressure sensor, a nitrogen partial pressure of the respiratory gas during the diving is calculated on the basis of the detection and an amount of nitrogen in the body is simulated from the nitrogen partial pressure of the respiratory gas and the diving time, so that a time (no-decompression divable time) until the nitrogen partial pressure reaches an allowable value of the nitrogen partial pressure in the body at any water depth and a time (body nitrogen discharge time) until the nitrogen partial pressure in the body is lowered to an equilibrium value over the water are obtained.

Thereby, even when a diver does not take the rest time enough for the inert gas excessively accumulated in the body to be completely discharged on shore, it is possible to report information for safe diving to the diver in advance.

Also, for example, a Japanese Patent Application Publication No. Hei 11-23747A discloses that the current surfacing speed is obtained every six seconds, the surfacing speed and an allowable value of the surfacing speed corresponding to a current water depth are compared, and when the surfacing speed is greater than the allowable value of the surfacing speed, a warning is issued.

In the meantime, Article 18, Paragraph 1(1) of the Ordinance on safety and health of work under high pressure referred to for the diving operation prescribes "the decompression speed should be equal to or less than 0.08 mega pascal every minute." When the decompression speed (surfacing speed) is set to 10 m per minute, it becomes 0.17 m per second.

According to the technology disclosed in Patent Document 1, it is possible to determine the surfacing speed in correspondence to the water depth. However, when the diver wears the wristwatch configured to measure the water depth on the arm, a measurement error of the water depth occurs due to an up-and-down movement of the diver's arm during the surfacing.

More specifically, the surfacing speed exceeds the allowable value of the surfacing speed by the movement of moving the arms upward for a short time (for example, 2 to 3 seconds). To the contrary, a diving state may be erroneously detected by the movement of moving the arms downward during the surfacing.

In order to prevent the measurement error of the water depth due to the movement of the diver's arms, it is considered to reduce an error due to the movement of the diver's arms by prolonging the measurement time period. In this case, however, the determination is delayed.

SUMMARY OF THE INVENTION

An object of the disclosure is to provide a warning notification device, an electronic watch, a warning method and a (non-transitory) recording medium configured to issue a surfacing speed violation warning with high precision while reducing an influence of movement of arms during diving.

A warning notification device according to an exemplary embodiment comprises:

a sensor;

a notification unit; and a processor, wherein the processor is configured to calculate a water depth from an output of the sensor every predetermined time and to calculate a surfacing amount from a change in the calculated water depth every predetermined time, and wherein when a long-term surfacing speed condition, which is to be determined on the basis of the surfacing amounts of a first number, is satisfied or when a short-term surfacing speed condition, which is to be determined on the basis of the recent surfacing amounts of a second number smaller than the first number, is satisfied, the processor enables the notification unit to issue a warning of a surfacing operation.

BRIEF DESCRIPTION OF THE DRAWINGS

FIG. 3 depicts a warning determination method of a surfacing speed by the electronic watch.

DETAILED DESCRIPTION

Hereinafter, an exemplary embodiment of the disclosure will be described in detail with reference to the drawings.

Figure 1:
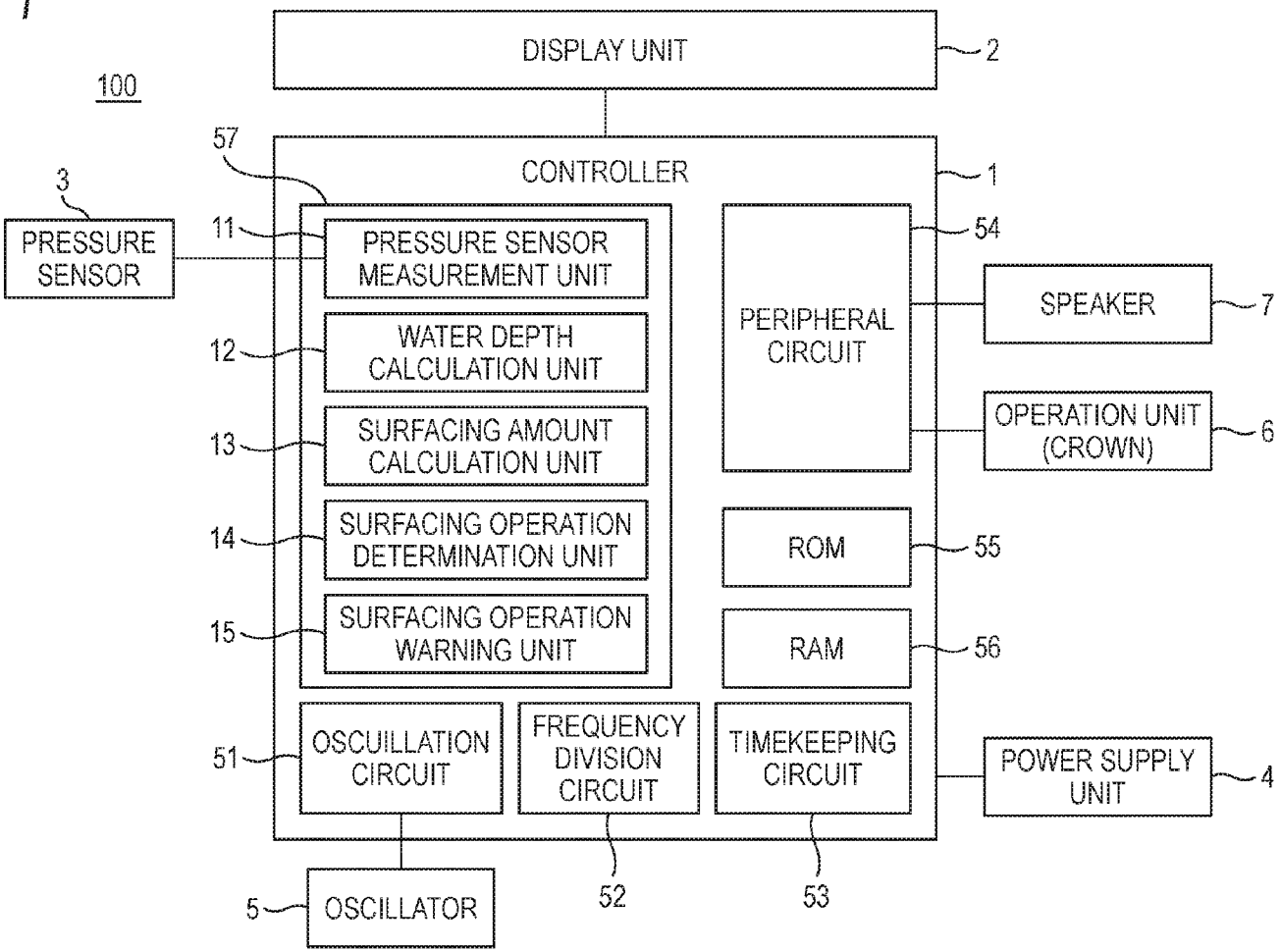
FIG. 1 is a block diagram depicting a configuration of an electronic watch of an exemplary embodiment.

FIG. 1 is a block diagram depicting a configuration of an electronic watch 100 of an exemplary embodiment.

The electronic watch 100 includes a display unit 2 configured to perform a digital display of a timekeeping display, a water depth display, and a warning display, a pressure sensor 3 configured to detect a water pressure during diving, a power supply unit 4, which is an operation power supply of the electronic watch 100, an oscillator 5, which is a reference of watch timekeeping, an operation unit (crown) 6 for operating the electronic watch 100, a speaker 7 configured to issue an alarm sound and a warning reporting sound of surfacing speed violation, and a controller 1 configured to control operations of the electronic watch 100.

Specifically, the display unit 2 is a digital panel display unit such as an LCD (liquid crystal display). Also, the display unit 2 has an EL (Electro Luminescence) panel embedded therein as a light, so that it turns on the light so as to improve the visibility of the display when the display is dark.

As the pressure sensor 3, a semiconductor pressure sensor configured to use a piezo resistance effect is used. In the electronic watch 100, the controller 1 is configured to capture an output of the pressure sensor 3 at a predetermined capturing timing (one second, in the exemplary embodiment) and to calculate a water depth from the pressure.

In the power supply unit 4, a secondary battery configured to be charged by a solar cell provided for the display unit 2 is used. Although described in detail later, in order to save power consumption of the power supply unit 4, the controller 1 is configured to perform control of limiting operations of the pressure sensor 3 and the speaker 7.

The operation unit (crown) 6 is operated by a user and is configured to change a watch mode and an operation mode such as a diving mode of the electronic watch 100 and to set time of the electronic watch 100.

The speaker 7 is a piezoelectric speaker or piezoelectric buzzer using a piezo element.

The controller 1 has a processor 57, a ROM (Read Only Memory) 55 (i.e., a non-transitory recording medium), and a RAM (Random Access Memory) 56. The processor 57 is configured to implement functions of the electronic watch 100 while referring to the RAM 56, based on a program recorded in the ROM 55 (non-transitory recording medium).

Specifically, the processor 57 is configured to implement a pressure sensor measurement unit 11, as a program function, on the basis of a pressure sensor measurement command of the program. Also, the processor 57 is configured to implement a water depth calculation unit 12 on the basis of a water depth calculation command of the program, a surfacing amount calculation unit 13 on the basis of a surfacing amount calculation command of the program, a surfacing operation determination unit 14 on the basis of a surfacing operation determination command of the program, and a surfacing operation warning unit 15 on the basis of a surfacing operation warning command of the program. The pressure sensor measurement unit 11, the water depth calculation unit 12, the surfacing amount calculation unit 13, the surfacing operation determination unit 14 and the surfacing operation warning unit 15 may be a single processor or may have a processor separately provided and perform each operation. Also, when each operation is performed with the processor separately provided, a single controller may be provided or a separate controller may be respectively provided.

The pressure sensor measurement unit 11, the water depth calculation unit 12, the surfacing amount calculation unit 13, the surfacing operation determination unit 14 and the surfacing operation warning unit 15 to be implemented as the program functions will be described in detail later.

Also, the controller 1 has an oscillation circuit 51 configured to oscillate the oscillator 5, a frequency division circuit 52 configured to frequency-divide an output of the oscillation circuit 51, and a timekeeping circuit 53 configured to clock a signal of the oscillator frequency-divided at the frequency division circuit 52 for a watch or a timer.

Also, the controller 1 has a peripheral circuit 54 configured to acquire operation information from the operation unit (crown) 6 and to output an alarm sound and a warning reporting sound of the surfacing speed to the speaker 7.

In the electronic watch 100 of the exemplary embodiment, the warning reporting sound is output from the speaker 7, the display unit 2 is enabled to make a warning display, and the speaker 7 and the display unit 2 may also be referred to as a notification unit configured to issue a warning of the surfacing speed.

Subsequently, an outline of the surfacing speed warning of the electronic watch 100 of the exemplary embodiment is described with reference to FIGS. 2 and 3.

Figure 2:
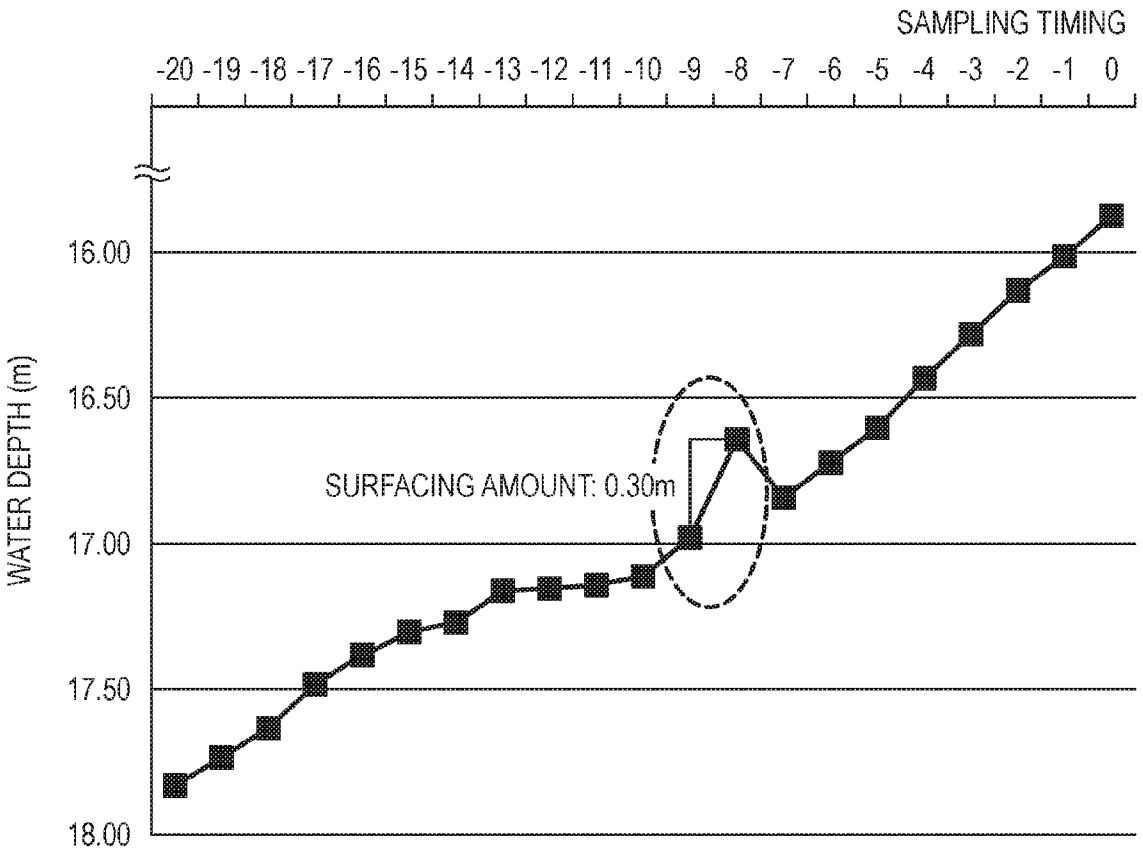
FIG. 2 depicts an example of a change in water depth during surfacing.

FIG. 2 depicts an example of a change in water depth during surfacing. In FIG. 2, a vertical axis indicates the water depth, and a horizontal axis indicates a sampling timing (number of times) every one second. In FIG. 2, "0" indicates the current, and twenty (20) water depths measured previously are plotted. In the meantime, since the water depth is sampled every one second, the change in water depth is equivalent to the surfacing speed.

The change in water depth (surfacing amount) from the ninth previous sampling timing to the eighth previous sampling timing (refer to a circular area shown with the dotted line) is the surfacing amount of 0.30 m. As described above, since the allowable value of the surfacing speed is 0.17 m per second, the change in water depth (surfacing amount) from the ninth previous sampling timing to the eighth previous sampling timing exceeds the allowable value of the surfacing speed. However, there is a possibility that the change in water depth of 0.3 m might be caused due to the upward movement of the arms during the surfacing.

For this reason, the electronic watch 100 of the exemplary embodiment issues a warning of the surfacing speed when a moving average value of the eighteen previous surfacing amounts (for 18 seconds) is equal to or greater than the allowable value of the surfacing speed. Thereby, it is possible to reduce an influence of the movement of the arm to which the electronic watch 100 is mounted, as shown in FIG. 2.

However, even when the moving average value of the water depth is obtained, there is a problem that the surfacing may be performed at excessive speed during the number of times of taking the average (for 18 seconds).

Therefore, the electronic watch 100 of the exemplary embodiment issues a warning of the surfacing speed when the change in the five (5) recent water depths (surfacing amounts) is equal to or greater than the allowable value of the surfacing speed, in addition to the determination by the moving average value of the eighteen (18) previous surfacing amounts. Thereby, when there is no influence of the movement of the arm, for example, it is possible to issue the warning of the surfacing speed in a short time.

FIG. 3 depicts a warning determination method of the surfacing speed by the electronic watch of 100 of the exemplary embodiment.

The electronic watch 100 of the exemplary embodiment is configured to perform a moving average surfacing speed determination A and a recent minimum surfacing speed determination B. In the moving average surfacing speed determination A, "when an average surfacing amount of 18 points is equal to or greater than a predetermined threshold, a surfacing speed warning is issued" (long-term surfacing speed condition) is set as a warning determination condition, and in the recent minimum surfacing speed determination B, "when a surfacing speed is equal to or greater than a predetermined value for five consecutive points, a surfacing speed warning is issued" (short-term surfacing speed condition) is set as a warning determination condition. Thereby, when any warning determination condition is satisfied, the surfacing speed warning is issued.

That is, the electronic watch 100 of the exemplary embodiment is configured to perform the warning determination of the surfacing speed on the basis of the surfacing amount every each predetermined time.

In the meantime, the number (18) of the moving average and the time period (5) for obtaining the minimum value are not limited to the above.

Subsequently, surfacing speed warning processing that is to be executed by the controller 1 of the electronic watch 100 is described with reference to FIGS. 4 and 5.

The surfacing speed warning processing is executed in a diving mode that is activated when the predetermined operation unit (crown) 6 of the electronic watch 100 is pushed. In the diving mode, the water depth/diving time/current time and the like are displayed on the display unit 2. In the diving mode, when the predetermined operation unit (crown) 6 is pushed, the electronic watch 100 returns to a watch mode.

Figure 4:
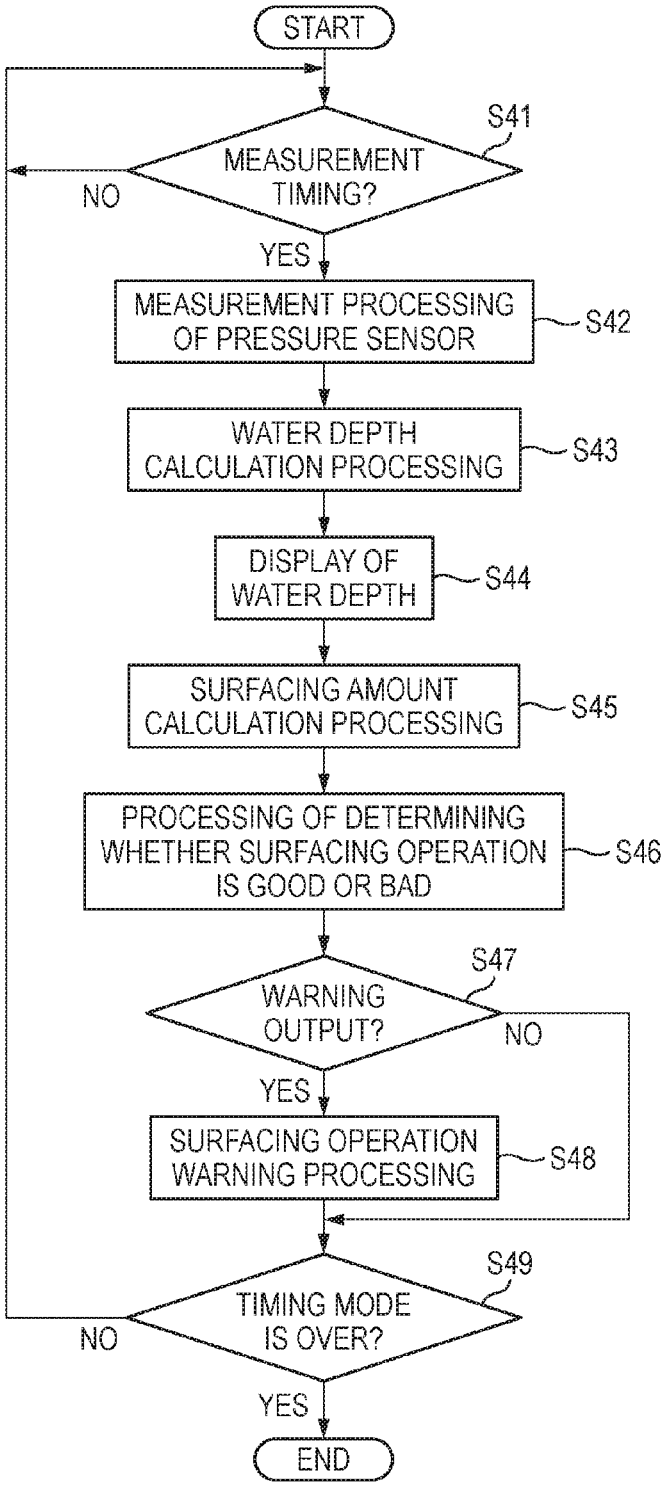
FIG. 4 is a schematic flowchart of water depth display/surfacing operation warning processing.
Figure 5:
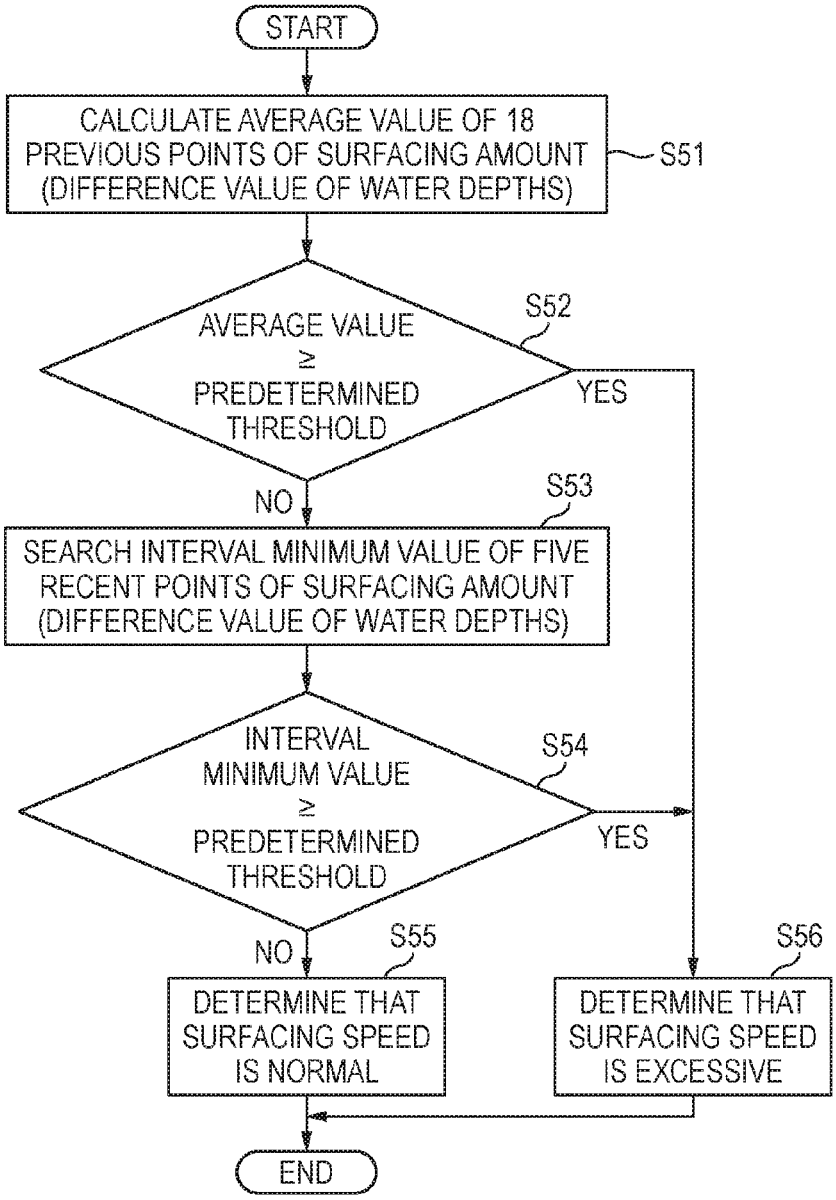
FIG. 5 is a control flowchart of processing of determining whether a surfacing operation is good or bad.

FIG. 4 is a schematic flowchart of water depth display/surfacing operation warning processing to be executed in the diving mode.

First, the controller 1 (refer to FIG. 1) of the electronic watch 100 of the exemplary embodiment determines whether it is the water depth measurement timing of a period of one second (S41). When it is the measurement timing (Yes in S41), the controller 1 proceeds to step S42, and when it is not the measurement timing (No in S41), the controller 1 stands by.

In step S42, the pressure sensor measurement unit 11 (refer to FIG. 1) of the controller 1 executes measurement processing of the pressure sensor 3, in which a pressure value is to be acquired from the pressure sensor 3 (refer to FIG. 1).

At this time, in order to save the power consumption of the power supply unit 4 (refer to FIG. 1) of the electronic watch 100 of the exemplary embodiment, it is assumed that the pressure sensor measurement unit 11 measures the same pressure value as the previously acquired value without acquiring the pressure value from the pressure sensor 3 when the warning reporting sound of the surfacing speed is being issued or when the power supply unit 4 is at a capacity-dropped state. Also, it is assumed that when the light of the display unit 2 (refer to FIG. 1) is turned on, the pressure sensor measurement unit 11 measures the same pressure value as the previously acquired value.

Then, in step S43, the water depth calculation unit 12 (refer to FIG. 1) executes processing of calculating a water depth value from the pressure value.

In the water depth calculation processing, when the pressure sensor 3 is a sensor configured to output a gauge pressure, the pressure value is preferably converted into a water depth value. When the pressure sensor 3 is a sensor configured to output an absolute pressure, a gauge pressure is obtained by setting a pressure value upon the setting of the diving mode as an atmospheric pressure of a water surface and the pressure value is converted into a water depth value.

The converted water depth value is displayed on the display unit 2 of the electronic watch 100 (S44). At this time, the diving time displayed on the display unit 2 is also updated.

In step S45, the surfacing amount calculation unit 13 (refer to FIG. 1) calculates a surfacing amount of the diver by calculating a difference between the water depth value obtained in the previous measurement timing and the currently obtained water depth value. The surfacing amount calculation unit 13 stores the plurality of previous calculated surfacing amounts (for example, the 18 surfacing amounts) so as to determine whether a surfacing operation is good or bad, which will be described later.

In the meantime, when the water depth increases (diving), the surfacing amount calculation unit 13 stores the surfacing amount as "0".

Also, in step S42, when the pressure value is not acquired from the pressure sensor 3, the same water depth is obtained in step S43 because it is assumed that the same pressure value as the previously acquired value is measured, and in step S45, the surfacing amount is treated as "0".

Then, in step S46, the surfacing operation determination unit 14 determines whether a surfacing operation is good or bad, based on the plurality of previous surfacing amounts. In other words, since the plurality of surfacing amounts is acquired with the period of one second, the surfacing operation determination unit 14 determines whether the surfacing speed is good or bad, on the basis of the plurality of surfacing speed values.

The processing of the surfacing operation determination unit 14 in step S46 will be described in detail later with reference to FIG. 5.

In step S47, the surfacing operation warning unit 15 determines whether or not to output a warning, in accordance with a determination result of the surfacing operation in step S46. That is, when it is determined in step S46 that the surfacing operation (surfacing speed) is normal, the surfacing operation warning unit 15 proceeds to step S49 (No in S47) because it is not necessary to output a warning. When it is determined that the surfacing operation is bad (the surfacing speed is excessive), the surfacing operation warning unit 15 proceeds to step S48 (Yes in S47) because it is necessary to output a warning.

In step S48, the surfacing operation warning unit 15 (refer to FIG. 1) outputs a warning reporting sound to the speaker 7 (refer to FIG. 1) and displays a warning of the surfacing operation (surfacing speed) on the display unit 2. The warning reporting sound will be described in detail later with reference to FIG. 7. Also, the warning display will be described in detail later with reference to FIG. 6.

In step S49, the controller 1 determines whether an operation of ending the diving mode and returning to the watch mode is instructed through the operation unit (crown) 6. When there is no instruction of ending the diving mode (No in S49), the controller 1 proceeds to step S41 and measures a next pressure. When an instruction of ending the diving mode is issued (Yes in S49), the controller 1 ends the water depth display/surfacing operation warning processing.

In the below, the processing of determining whether the surfacing operation is good or bad in step S46 of FIG. 4 is described in detail with reference to FIG. 5.

First, the surfacing operation determination unit 14 calculates an average value of 18 previous points of the surfacing amount (difference value of the water depths) calculated in step S45 of FIG. 4 (S51).

Then, since the surfacing amount is equivalent to the surfacing speed, the surfacing operation determination unit 14 determines whether the calculated average value of the surfacing amounts is equal to or greater than a predetermined threshold, which is the allowable value of the surfacing speed (S52). When the average value of the surfacing amounts is equal to or greater than the predetermined threshold (Yes in S52), the surfacing operation determination unit 14 proceeds to step S56 and determines that the surfacing speed is excessive. When the average value of the surfacing amounts is smaller than the predetermined threshold (No in S52), the surfacing operation determination unit 14 proceeds to step S53.

The above-described processing corresponds to the moving average surfacing speed determination A of FIG. 3.

More specifically, the surfacing operation determination unit 14 adds the surfacing amount of 18 points in step S51, and compares the added value of the surfacing amount and an 18-times value of the allowable value of the surfacing speed calculated in advance, in step S52.

Thereby, it is possible to perform the determination without division (multiplication) processing.

Then, the surfacing operation determination unit 14 executes processing corresponding to the recent minimum surfacing speed determination B of FIG. 3.

In step S53, the surfacing operation determination unit 14 searches an interval minimum value of five recent points of the surfacing amount (difference value of the water depths) calculated in step S45 of FIG. 4.

Then, in step S54, the surfacing operation determination unit 14 determines whether the interval minimum value of five recent points is equal to or greater than a predetermined threshold, which is the allowable value of the surfacing speed. When the interval minimum value of five recent points is equal to or greater than the predetermined threshold (Yes in S54), the surfacing operation determination unit 14 proceeds to step S56 and determines that the surfacing speed is excessive.

When interval minimum value of five recent points is smaller than the predetermined threshold (No in S54), the surfacing operation determination unit 14 determines that the surfacing speed is normal (S55) and ends the processing.

The predetermined thresholds in step S52 and step S54 may be the same, and the predetermined threshold in step S54 may be set greater than the predetermined threshold in step S51.

As a method of obtaining the same determination result that is the same as a method by a combination of the moving average surfacing speed determination and the recent minimum surfacing speed determination, a method of performing the determination by convolution processing of a surfacing amount weighted so as to increase a recent influence is considered. However, according to the determination by the convolution processing of the surfacing amount, addition and multiplication calculations (adder and multiplier) are required. Therefore, it can be said that the determination method of the exemplary embodiment capable of performing the determination by the addition calculation (adder) has lower performance load and logical scale and is effective to save the power of the controller 1.

Figure 6:
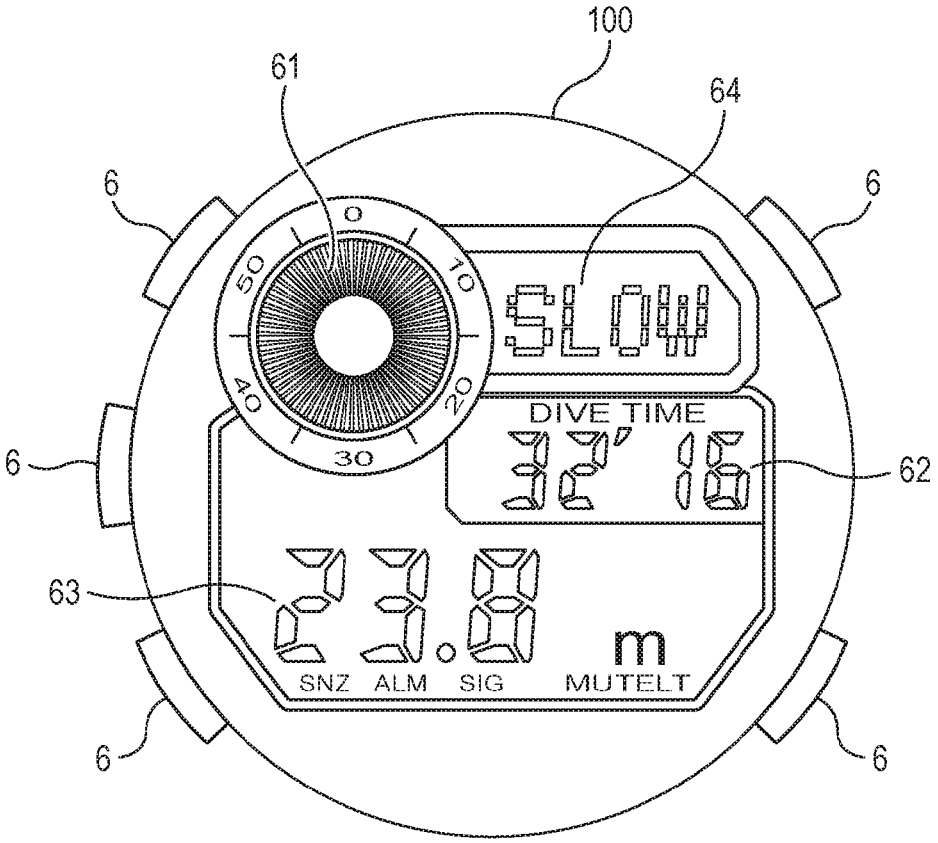
FIG. 6 depicts an example of an outward appearance of the electronic watch in a diving mode.

FIG. 6 depicts an example of an outward appearance of the electronic watch 100 in the diving mode.

A periphery of the electronic watch 100 is provided with a plurality of operation units (crowns) 6. The operation mode of the electronic watch 100 changes depending on pushed states of the operation units.

The display unit 2 (refer to FIG. 1) of the electronic watch 100 is configured to perform display control of a water depth meter 61, which is configured to expand a central angle thereof in association with the change in water depth and to graphically display a magnitude of the water depth in a fan shape, a display area 62 of the diving time, a display area 63 of the water depth and a warning display area 64.

When the surfacing operation warning unit 15 (refer to FIG. 1) executes the surfacing operation warning processing of step S48 in FIG. 4, the display unit 2 performs a blinking display (2 Hz) of "SLOW", which is a surfacing speed violation warning indicating that the surfacing speed is excessive, in the warning display area 64 and also performs a blinking display (2 Hz) in the water depth meter 61, the display area 62 of the diving time and the display area 63 of the water depth.

After the display unit 2 performs the warning reporting sound and the blinking display, which will be described later, for five seconds, it performs the blinking display for five seconds even after the reporting sound is over.

Figure 7:
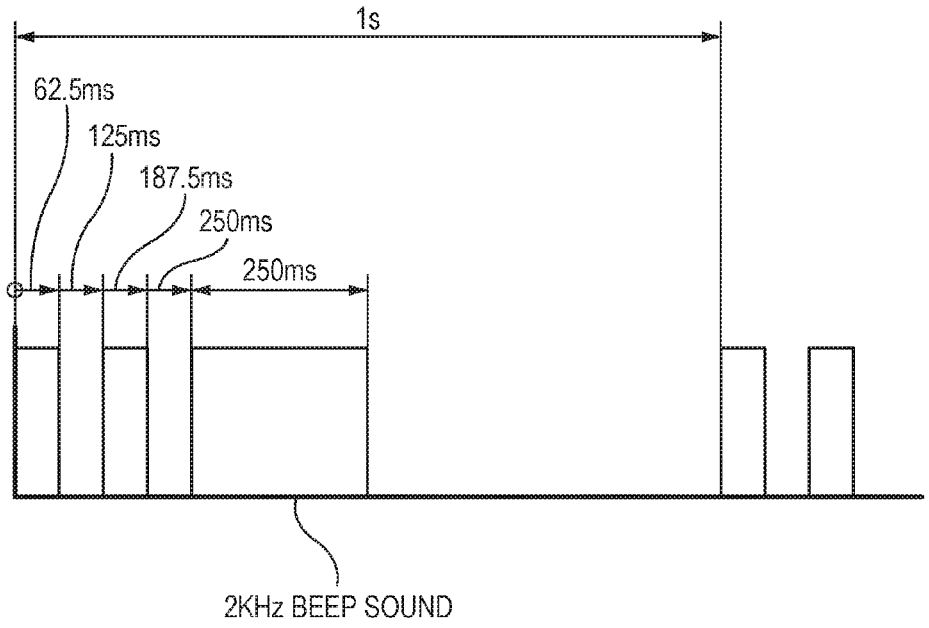
FIG. 7 depicts an example of an output pattern of a warning sound.

FIG. 7 depicts an example of an output pattern of a warning sound, which is the reporting sound to be output from the speaker 7 (refer to FIG. 1) of the electronic watch 100.

As shown in FIG. 7, as the warning sound, a warning sound configured by a combination of an intermittent sound of two short beep sounds (62.5 ms) of 2 KHz and an intermittent sound of a long beep sound (250 ms) of 2 KHz is repeatedly output for five seconds. In this way, the long beep sound is mixed to improve the ease listening in the water.

When the surfacing speed is not lowered even after the warning processing (ten seconds) of the surfacing operation, the warning is preferably continued.

In the electronic watch 100 of the exemplary embodiment, during the reporting sound, since the measurement cannot be performed, the processing is performed as if there is no change in water depth (surfacing amount 0). However, in the measurement after the reporting sound is over, since the surfacing amount during the reporting sound is also measured, it is possible to re-issue the warning in a short time.

In the exemplary embodiment, the electronic watch configured to perform the digital display has been described. However, the disclosure is not limited thereto, and an electronic watch configured to perform the display by analog hands is also possible.

In the exemplary embodiment, the electronic watch has been described as the warning notification device. However, the disclosure can also be applied to a measurement device such as a water depth meter that is to be carried by a diver.

In the exemplary embodiment, when the surfacing operation warning unit 15 executes the surfacing operation warning processing of step S48 in FIG. 4, the display unit 2 performs the blinking display (2 Hz) of "SLOW", which is a surfacing speed violation warning indicating that the surfacing speed is excessive, in the warning display area 64 and also performs the blinking display (2 Hz) in the water depth meter 61, the display area 62 of the diving time and the display area 63 of the water depth. However, the disclosure is not limited thereto. For example, when the surfacing operation warning unit 15 executes the surfacing operation warning processing of step S48 in FIG. 4, the display unit 2 may perform the blinking display (2 Hz) of "SLOW", which is a surfacing speed violation warning indicating that the surfacing speed is excessive, in the warning display area 64 and also perform the blinking display (2 Hz) in the water depth meter 61. Also, at the same time, a backlight of the display unit 2 may be turned on.

Also, in exemplary embodiment, the warning sound, which is to be reported from the speaker 7 of the electronic watch 100, is the warning sound configured by the combination of the intermittent sound of two short beep sounds of 2 KHz and the intermittent sound of the long beep sound of 2 KHz. However, the disclosure is not limited thereto. For example, the warning sound, which is to be reported from the speaker 7 of the electronic watch 100, may be a sound of a frequency band that can be more easily audible to the human ear, such as a warning sound configured by a combination of an intermittent sound of two short beep sounds of 1 to 4 KHz and an intermittent sound of a long beep sound of 1 to 4 KHz.

What is claimed is:

1. A warning notification device comprising:

a sensor;

a notification unit; and a processor, wherein the processor is configured to calculate a water depth from an output of the sensor every predetermined time and to calculate a surfacing amount from a change in the calculated water depth every predetermined time, wherein when a long-term surfacing speed condition, which is to be determined based on a first number of surfacing amounts calculated by the processor, is satisfied, the processor controls the notification unit to issue a warning of a surfacing operation, wherein when a short-term surfacing speed condition, which is to be determined based on a second number of recent surfacing amounts calculated by the processor, is satisfied, the processor controls the notification unit to issue a warning of a surfacing operation, the second number being smaller than the first number, and wherein the second number of recent surface amounts, based on which the short-term surfacing speed condition is determined, are calculated more recently than at least some of the first number of surfacing amounts based on which the long-term surfacing speed condition is determined.

2. The warning notification device according to claim 1, wherein the processor determines whether the long-term surfacing speed condition is satisfied by calculating a moving average of the first number of surfacing amounts as an average surfacing speed and determining whether the average surfacing speed is equal to or greater than a first threshold, as the long-term surfacing speed condition, and wherein the processor determines whether the short-term surfacing speed condition is satisfied by searching for a minimum value among the second number of recent surfacing amounts as a minimum surfacing speed and determining whether the minimum surfacing speed is equal to or greater than a second threshold, as the short-term surfacing speed condition.

3. The warning notification device according to claim 1, wherein the notification unit comprises a sound reporting unit, and wherein the processor is configured to control the sound reporting unit to output a warning reporting sound configured by a combination of a short beep sound and a long beep sound.

4. The warning notification device according to claim 2, wherein the notification unit comprises a sound reporting unit, and wherein the processor is configured to control the sound reporting unit to output a warning reporting sound configured by a combination of a short beep sound and a long beep sound.

5. The warning notification device according to claim 3, wherein the notification unit further comprises a display unit, wherein the processor is configured to control the sound reporting unit to output the warning reporting sound and to control the display unit to display a warning display, and wherein after the output of the warning reporting sound is stopped, the processor stops the display of the warning display.

6. The warning notification device according to claim 4, wherein the notification unit further comprises a display unit, wherein the processor is configured to control the sound reporting unit to output the warning reporting sound and to control the display unit to display a warning display, and wherein after the output of the warning reporting sound is stopped, the processor stops the display of the warning display.

7. The warning notification device according to claim 1, wherein the processor sets the surfacing amount to zero when the change in the calculated water depth increases.

8. The warning notification device according to claim 2, wherein the processor sets the surfacing amount to zero when the change in the calculated water depth increases.

9. The warning notification device according to claim 3, wherein the processor sets the surfacing amount to zero when the change in the calculated water depth increases.

10. The warning notification device according to claim 4, wherein the processor sets the surfacing amount to zero when the change in the calculated water depth increases.

11. The warning notification device according to claim 1, wherein the processor calculates the same value as a previously detected water depth when a power supply voltage of an embedded battery is low or when the notification unit is controlled to issue the warning of the surfacing operation.

12. The warning notification device according to claim 2, wherein the processor calculates the same value as a previously detected water depth when a power supply voltage of an embedded battery is low or when the notification unit is controlled to issue the warning of the surfacing operation.

13. The warning notification device according to claim 3, wherein the processor calculates the same value as a previously detected water depth when a power supply voltage of an embedded battery is low or when the notification unit is controlled to issue the warning of the surfacing operation.

14. The warning notification device according to claim 4, wherein the processor calculates the same value as a previously detected water depth when a power supply voltage of an embedded battery is low or when the notification unit is controlled to issue the warning of the surfacing operation.

15. The warning notification device according to claim 5, wherein the processor calculates the same value as a previously detected water depth when the display unit is controlled to display the warning display.

16. The warning notification device according to claim 6, wherein the processor calculates the same value as a previously detected water depth when the display unit is controlled to display the warning display.

17. An electronic watch comprising:

the warning notification device according to claim 1; and a display configured to display a time, wherein the processor is configured to measure the time to be displayed on the display.

18. An electronic watch comprising:

the warning notification device according to claim 2; and a display configured to display a time, wherein the processor is configured to measure the time to be displayed on the display.

19. A warning method of a warning notification device comprising a sensor and notification unit, the warning method comprising:

calculating a water depth from an output of the sensor every predetermined time;

calculating a surfacing amount from a change in the calculated water depth every predetermined time;

controlling the notification unit to issue a warning of a surfacing operation when a long-term surfacing speed condition, which is to be determined based on a first number of surfacing amounts calculated in the calculating, is satisfied; and controlling the notification unit to issue a warning of a surfacing operation when a short-term surfacing speed condition, which is to be determined based on a second number of recent surfacing amounts calculated in the calculating, is satisfied, wherein the second number is smaller than the first number, and wherein the second number of recent surface amounts, based on which the short-term surfacing speed condition is determined, are calculated more recently than at least some of the first number of surfacing amounts based on which the long-term surfacing speed condition is determined.

20. A non-transitory recording medium having a program recorded therein, which is executable by a processor of a warning notification device comprising a sensor, a notification unit and the processor, the program being executable by the processor to cause the processor to perform functions comprising:

calculating a water depth from an output of the sensor every predetermined time;

calculating a surfacing amount from a change in the calculated water depth every predetermined time;

controlling the notification unit to issue a warning of a surfacing operation when a long-term surfacing speed condition, which is to be determined based on a first number of surfacing amounts calculated in the calculating, is satisfied; and controlling the notification unit to issue a warning of a surfacing operation when a short-term surfacing speed condition, which is to be determined based on a second number of recent surfacing amounts calculated in the calculating, is satisfied, wherein the second number is smaller than the first number, and wherein the second number of recent surface amounts, based on which the short-term surfacing speed condition is determined, are calculated more recently than at least some of the first number of surfacing amounts based on which the long-term surfacing speed condition is determined.

* * * * *